US009394748B2

(12) United States Patent
Heyward et al.

(10) Patent No.: US 9,394,748 B2
(45) **Date of Patent: *Jul. 19, 2016**

(54) RISER-MOUNTED GUIDE ASSEMBLY FOR UMBILICAL DEPLOYMENT

(75) Inventors: Thomas B. Heyward, Houston, TX (US); John Rodney Hensely, Katy, TX (US); Evan P. Graybill, Houston, TX (US); Andrew Boyd, Houston, TX (US); Kalyan Vajapeyajula, Houston, TX (US); Andreas Stamatiou, Houston, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 39 days.

This patent is subject to a terminal disclaimer.

(21) Appl. No.: 13/217,440

(22) Filed: Aug. 25, 2011

(65) Prior Publication Data

US 2013/0048296 A1 Feb. 28, 2013

(51) Int. Cl.

| | |
|---|---|
| ***E21B 19/16*** | (2006.01) |
| ***E21B 17/01*** | (2006.01) |
| ***E21B 19/06*** | (2006.01) |
| ***E21B 31/12*** | (2006.01) |
| ***E21B 19/00*** | (2006.01) |

(52) U.S. Cl.
CPC ..... *E21B 19/002* (2013.01)

(58) Field of Classification Search
CPC ..... E21B 19/16; E21B 17/01; E21B 19/06; E21B 17/085; E21B 31/12
USPC ..... 166/338, 339, 349, 351, 360, 367, 166/378–380, 382, 85.1, 75.14
See application file for complete search history.

(56) References Cited

U.S. PATENT DOCUMENTS

| | | | | |
|---|---|---|---|---|
| 3,557,564 | A * | 1/1971 | Hauber | E21B 43/0107 166/358 |
| 3,664,621 | A * | 5/1972 | Savoie | E21B 43/0107 248/218.4 |
| 3,739,592 | A * | 6/1973 | Plake | F16L 3/00 16/265 |
| 4,059,872 | A * | 11/1977 | Delesandri | F16L 3/1008 24/279 |
| 4,116,015 | A * | 9/1978 | Duncan | E21B 33/038 24/458 |
| 4,386,659 | A * | 6/1983 | Shotbolt | E21B 33/038 166/342 |
| 4,423,982 | A * | 1/1984 | Zaremba | E21B 33/038 166/338 |
| 4,437,791 | A * | 3/1984 | Reynolds | 405/224.2 |
| 4,566,819 | A * | 1/1986 | Johnston | E04G 7/14 403/385 |
| 5,092,711 | A * | 3/1992 | Langner | E21B 43/0107 166/341 |
| 5,542,776 | A * | 8/1996 | Reynolds | F16L 3/1075 24/115 L |
| 5,593,249 | A * | 1/1997 | Cox et al. | 405/191 |
| 6,135,398 | A * | 10/2000 | Quesnel | H02G 7/053 248/74.1 |
| 6,431,502 | B1 * | 8/2002 | Goodman | E21B 17/1035 248/229.14 |
| 6,726,166 | B2 * | 4/2004 | Goodman | E21B 17/1035 248/229.14 |
| 6,786,302 | B2 * | 9/2004 | Liew | E04G 7/14 182/186.8 |

(Continued)

*Primary Examiner* — Matthew R Buck
*Assistant Examiner* — Edwin Toledo-Duran
(74) *Attorney, Agent, or Firm* — Melissa M. Hayworth; Mary R. Bram; Parul Anderson

(57) ABSTRACT

An apparatus and method for connecting an umbilical to a marine riser is provided. The method and apparatus can be employed in instances when a riser is already in place in the water, extending from a drilling vessel to subsea equipment on the ocean floor.

18 Claims, 7 Drawing Sheets

(56) References Cited

U.S. PATENT DOCUMENTS 6,971,413 B2 * 12/2005 Taylor ..... F16L 1/26 138/97
7,478,483 B2 * 1/2009 Wrzyszczynski ..... E21B 33/035 33/412
7,614,593 B2 * 11/2009 McClure ..... E21B 17/1035 248/229.14
7,861,982 B1 * 1/2011 McClure ..... F16L 3/1075 248/229.14
2005/0160959 A1 * 7/2005 Roodenburg et al. ..... 114/258
2009/0252559 A1 * 10/2009 Masters et al. ..... 405/195.1
2010/0209198 A1 * 8/2010 Piper et al. ..... 405/170
2012/0152556 A1 * 6/2012 Hensley ..... E21B 17/01 166/338

* cited by examiner

RISER-MOUNTED GUIDE ASSEMBLY FOR UMBILICAL DEPLOYMENT

TECHNICAL FIELD

The field of the invention is subsea drilling, including methods and apparatus for securing an umbilical to a subsea riser.

BACKGROUND

In subsea drilling operations, a marine riser with an attached umbilical is often deployed from a drill ship or platform to the sea floor. The umbilical can be configured to support subsea components, for example, the umbilical could be configured to provide subsea components with electrical, hydraulic, and optical power and control signals as well as chemical and gas delivery. A subsea umbilical is typically connected to a subsea riser concurrent with the subsea deployment of the riser. The connected assemblies of the riser and umbilical are then lowered together into the subsea environment as an integrated unit. Deploying the umbilical together with the riser allows the riser to provide support to the umbilical. However, this method can cause the deployment of the riser to be slower than otherwise possible. In addition, the known deployment methods can make servicing the riser or umbilical more difficult than otherwise because the umbilical is attached to and supported by the riser. There is a need for improved apparatus and methods for deploying and securing umbilicals.

SUMMARY

The present disclosure provides an apparatus and method for connecting an umbilical to a marine riser. The apparatus and method may be used when an umbilical is deployed independently of the deployment of the riser. The term 'independently' is used herein to mean that the umbilical is not necessarily coupled to the drilling riser during the time when the umbilical is lowered to the sea floor. For example, the method and apparatus can be employed in those instances when a riser is already in place in the water, extending from a drilling vessel to subsea equipment on the ocean floor. Such a deployment method is disclosed in provisional application Ser. No. 61/422,557, filed on Dec. 13, 2010, which is hereby incorporated by reference in its entirety.

The method of the present disclosure may include securing the umbilical to the riser with the assistance of a remotely operated subsea vehicle ("ROV"). The method also may include releasing the umbilical from the riser and retrieving it without removing the riser from the subsea environment.

The apparatus of the present disclosure may be in the form of an umbilical guide assembly which itself can be deployed and manipulated using a remotely operated subsea vehicle. In one embodiment of the invention, a number of umbilical guide assemblies may be employed in a spaced apart arrangement upon the riser assembly to secure an umbilical laterally and approximately parallel to a riser. This may be accomplished in a manner that allows for movement of the umbilical longitudinally with respect to the riser, which may be desirable.

DETAILED DESCRIPTION

Figure 1:
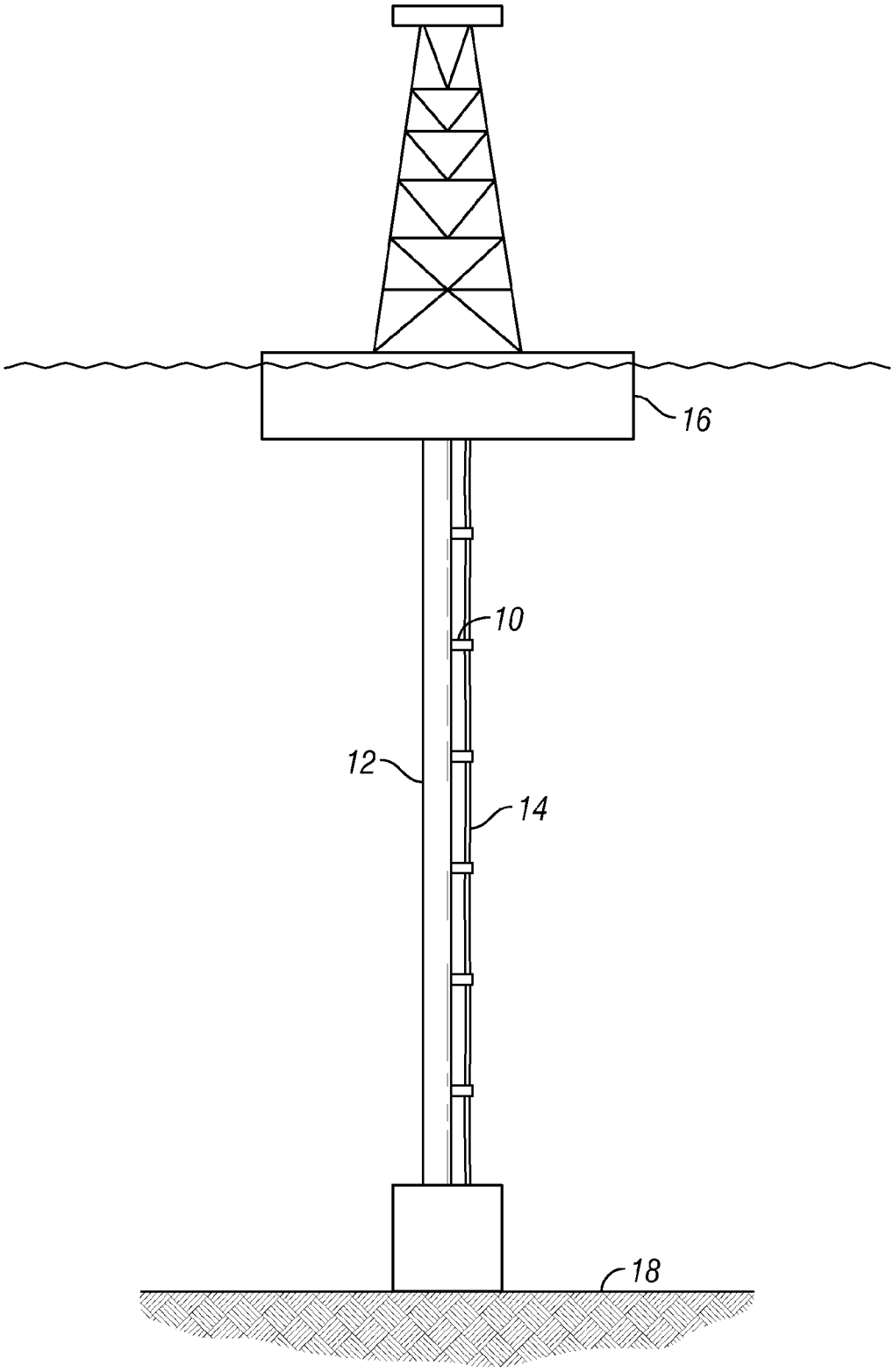
FIG. 1 is a schematic illustration of a guide assembly in operation connected between a riser and an umbilical.
Figure 3:
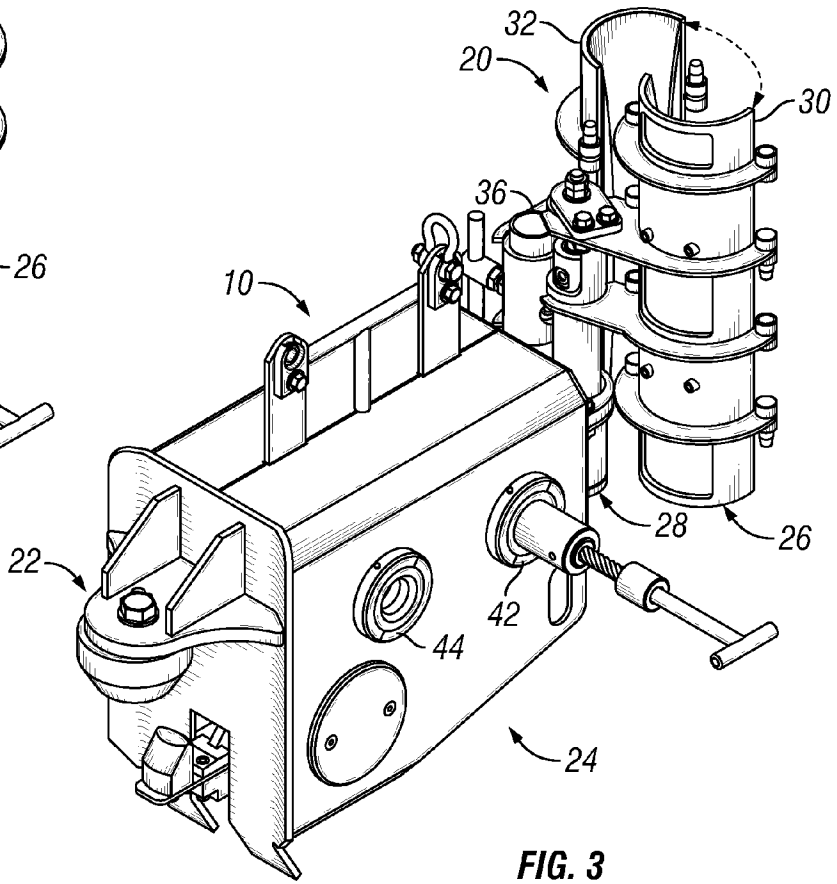
FIG. 3 is a top perspective view of the guide assembly of FIG. 2 with its umbilical interface in an open position and its riser interface in an unlocked position.

Referring to FIG. 1, the umbilical guide assemblies 10 are shown in operation. In the depicted embodiment the guide assemblies 10 are shown spaced apart vertically along a riser 12 and connected between the riser 12 and the umbilical 14. The guide assemblies 10 are configured to enable installation of the umbilical after the riser 12 has been fully deployed from the drilling vessel 16 and secured to the sea floor 18. The guide assemblies 10 are also configured to make it possible to retract the umbilical from the sea without disrupting the riser.

Referring to FIGS. 2-8, an embodiment of the guide assembly 10 is shown in greater detail. The guide assembly 10 includes an umbilical interface assembly 20 configured to interface with an umbilical, a riser interface assembly 22 configured to interface with the riser, and a frame assembly 24 that extends between the umbilical interface assembly 20 and the riser interface assembly 22. It should be appreciated that many other alternative embodiments of the present disclosure exist.

In the depicted embodiment umbilical interface assembly 20 includes a clam shell portion 26 and an umbilical interface actuation assembly 28. The clam shell portion 26 is configured to be driven to an opened orientation by the umbilical interface actuation assembly 28 wherein it is arranged to receive a segment of umbilical 14 and configured to be driven to a closed orientation by the umbilical interface actuation assembly 28 wherein it retains the segment of umbilical 14 therein. The clam shell portion 26 is shown in a closed orientation in FIGS. 2, 4, and 6 and shown in an open orientation in FIGS. 3 and 7.

In the depicted embodiment the clam shell portion 26 is configured to limit the movement of the umbilical in the horizontal plane (x-y plane) while allowing the umbilical to move freely in a vertical direction (z-direction). In the depicted embodiment, the clam shell portion 26 includes a generally cylindrical body having a first portion 30 that pivots relative to the second portion 32. In the depicted embodiment the first portion 30 moves about axis AA while the second portion 32 is stationary when the umbilical interface actuation assembly 28 is actuated. See FIGS. 6 and 7. In the depicted embodiment the first portion 30 pivots through at least 60 degrees (e.g., 90, degrees, 110 degrees) such that the first portion 30 is moved sufficiently out of the way so that the umbilical can be easily directed into the target area, which is adjacent the inner surface of the second portion 32. See FIG. 7.

In the depicted embodiment the umbilical interface actuation assembly 28 includes a frame mount 34 that supports a normally locked pivot connection 36 between the frame mount 34 and the second portion 32 of the clam shell portion 26, and a driven pivot connection 38 between the frame mount 34 and the first portion 30. The driven pivot connection 38 includes a hydraulic actuated device 40 that rotates the first portion 30 of the clam shell portion 26 relative to the second portion 32 of the clam shell portion 26. When the driven pivot connection 38 is rotated it engages locking pins that retain the first portion 30 to the second portion 32 so that continuous hydraulic pressure is not needed to keep the clam shell portion 26 closed. The normally locked pivot connection 36 is configured to normally be locked to prevent movement of the second portion 32, and configured to be mechanically unlocked to allow for movement of the second portion 32. Direct manual movement of the second portion 32 may be desirable in the event of a malfunction of the driven pivot connection 38 or actuation assembly 28.

In the depicted embodiment the umbilical interface actuation assembly 28 is driven by hydraulic fluid. In the depicted embodiment a hydraulic connection 42 is provided on a side surface of the frame assembly 24. The hydraulic connection 42 is configured such that a remotely operated vehicle can remove a plug from the hydraulic connection and temporarily store (park) the plug on a holding structure 44 on the frame assembly 24. Once the plug is removed, a hydraulic line can be provided by the remotely operated vehicle and can be directly connected to the hydraulic connection 42.

Figure 8:
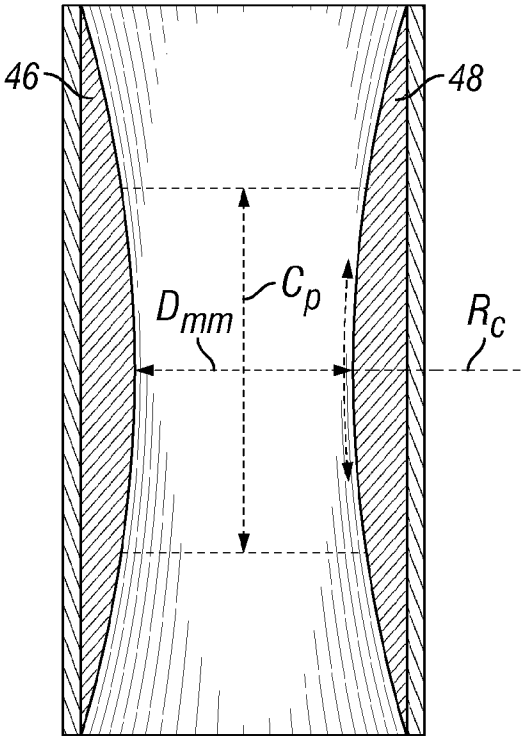
FIG. 8 is a cross-section of a portion of the umbilical interface of FIG. 2.

Referring to FIG. 8 the clam shell portion 26 of the umbilical interface 20 is described in greater detail. In the depicted embodiment the geometry of the clam shell portion 26 is configured to prevent damage to the umbilical due to bending, compression or excessive wear. In the depicted embodiment the inner surface forms a sleeve having a generally cylindrical outer shape and a pair of tapered wear inserts 46, 48 that are define its inner shape. In the depicted embodiment the wear inserts are tapered from both ends towards a central region. The minimum distance Dmin between the wear inserts 46, 48 is slightly larger than the maximum exterior diameter of the umbilical (e.g., the maximum exterior diameter of the umbilical could be 3.5 inches and the Dmin could be 3.8 inches).

Figure 13:
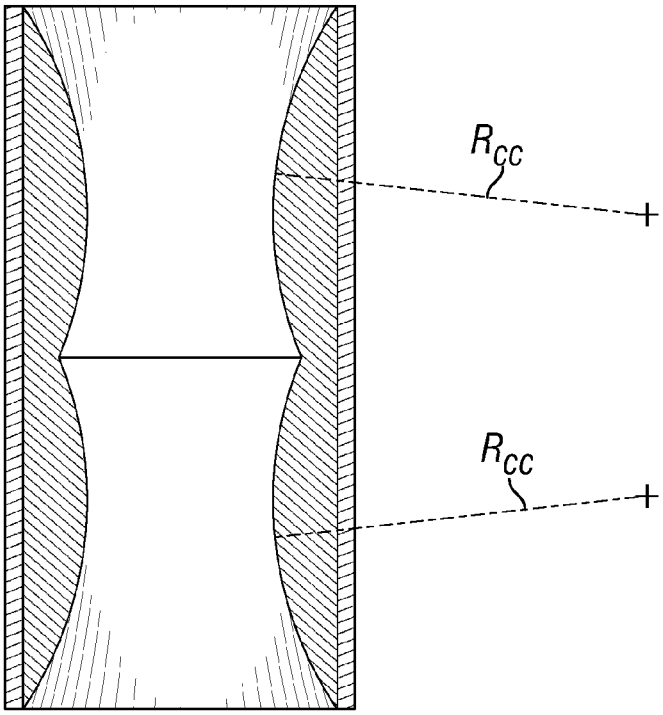
FIG. 13 is a cross-section of a portion of an alternative embodiment of the umbilical interface of FIG. 2.

In the depicted embodiment the cross-sectional profile of the wear inserts 46, 48 define a smooth curve wherein at least a portion of the curve has a radius of curvature that is greater than or equal to the minimum recommended radius of curvature for the umbilical. In the depicted embodiment the central portion Cp of the wear inserts has a radius of curvature Rc between 50-60 inches. This configuration prevents contact between the guide assembly and the umbilical from causing the umbilical to bend beyond its minimum recommended radius of curvature (e.g., a minimum recommended radius of curvature of 40 inches). In the depicted embodiment the entire cross-sectional profile includes a constant radius of curvature. Many alternative embodiments are also possible including embodiment with cross-sectional profiles defined by multiple curves. For example, FIG. 13 depicts one alternative embodiment wherein the cross-sectional profile includes two adjacent curves that each have a radius of curvature Rcc that is greater than or equal to the minimum recommended bend radius of the umbilical. In the depicted embodiment both curves have the same radius of curvature and the radius of curvatures are approximately 42 inches.

It should be appreciated that many other alternative configurations for the umbilical interface exists.

Figure 2:
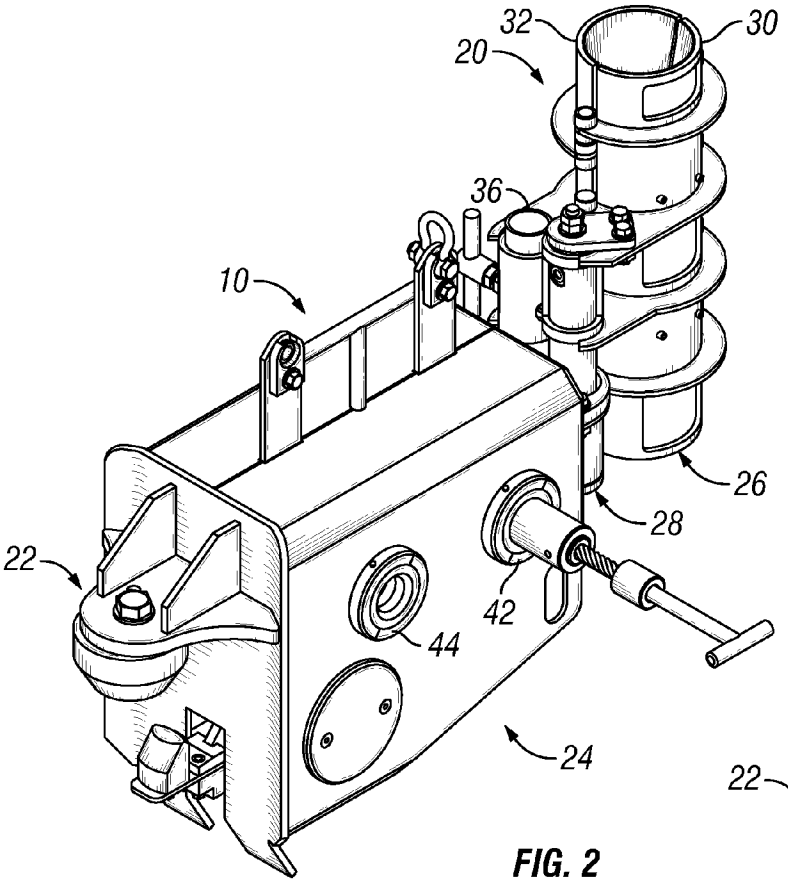
FIG. 2 is a top perspective view of the guide assembly according to the present disclosure with its umbilical interface in a closed position and its riser interface in a lock position.
Figure 5:
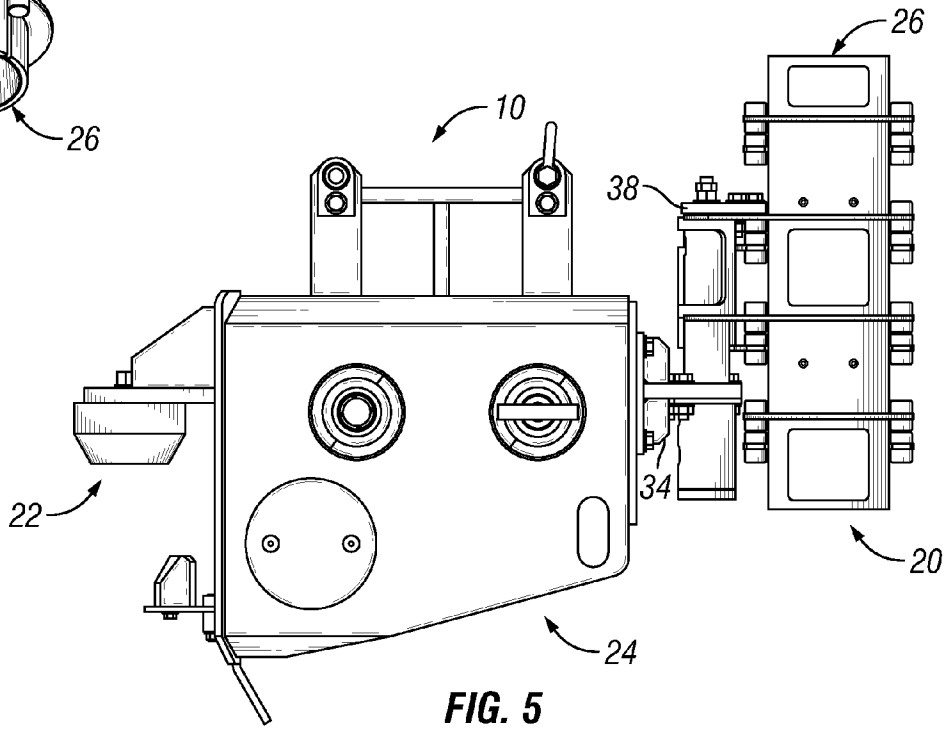
FIG. 5 is a side view of the guide assembly of FIG. 2.
Figure 4:
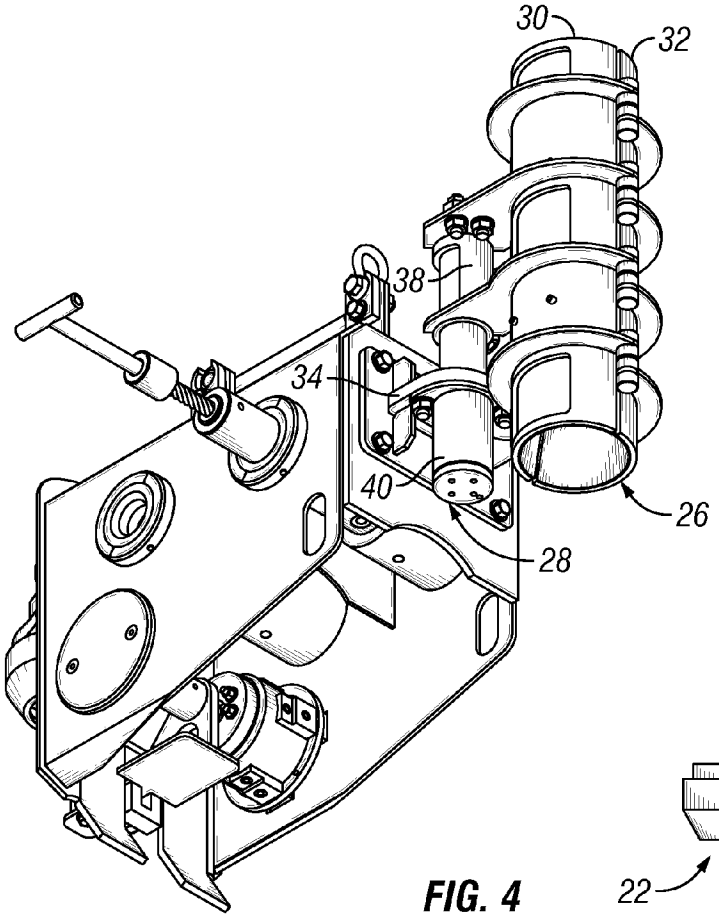
FIG. 4 is a bottom perspective view of the guide assembly of FIG. 2.
Figure 6:
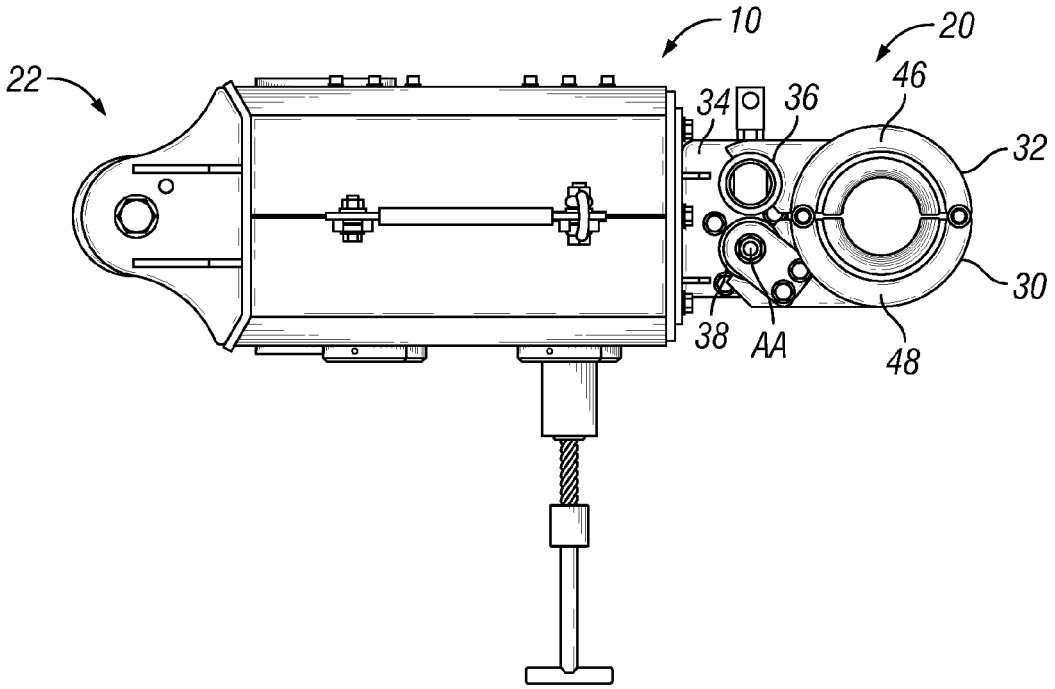
FIG. 6 is a top view of the guide assembly of FIG. 2 with its umbilical interface in a closed position.
Figure 7:
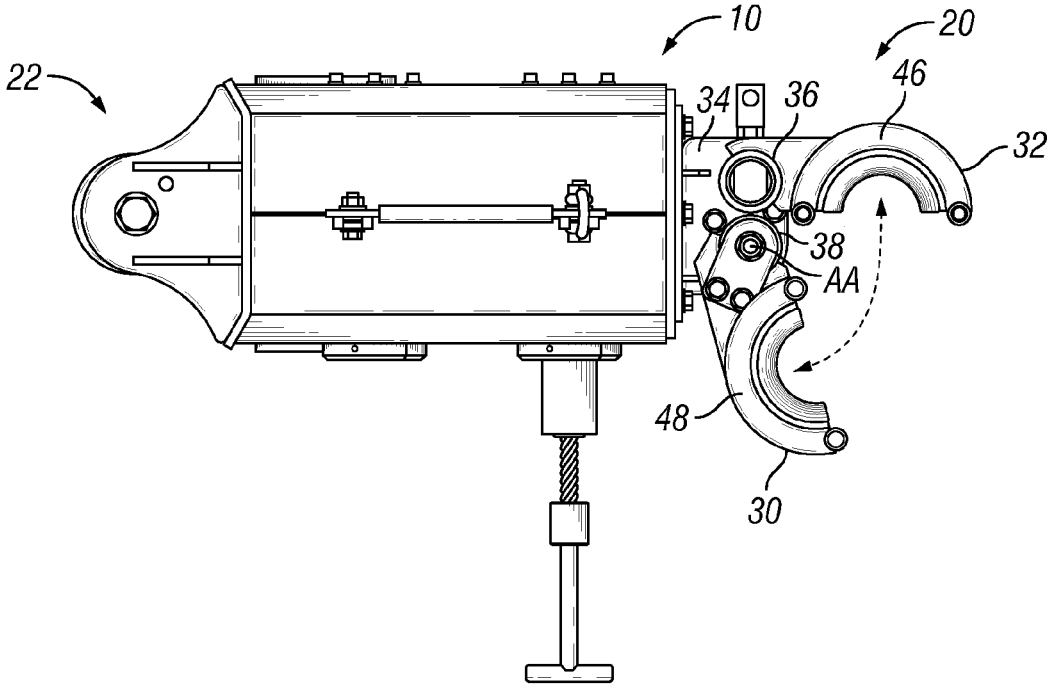
FIG. 7 is a top view of the guide assembly of FIG. 2 with its umbilical interface in an open position.
Figure 9:
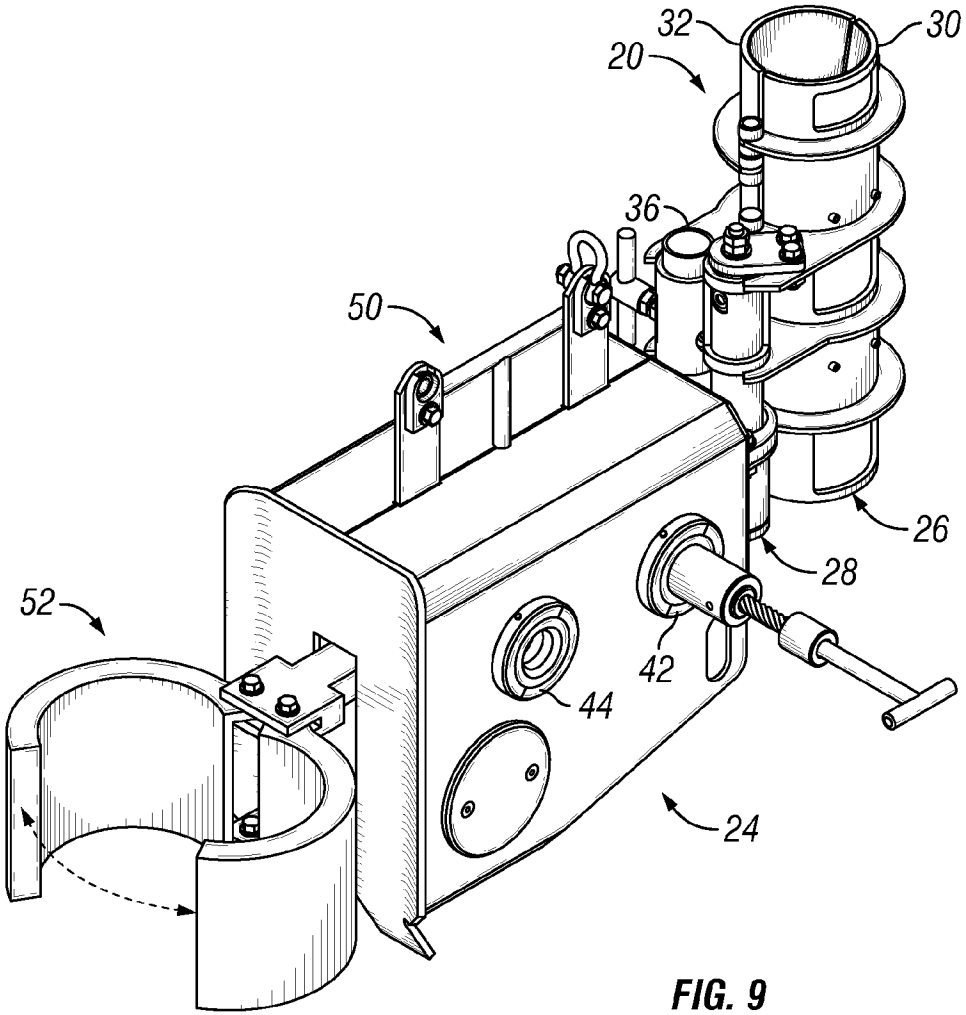
FIG. 9 is a perspective view of an alternative embodiment of the guide assembly of FIG. 2.

Referring to FIG. 9, an alternative embodiment of the umbilical guide assembly of FIG. 2 is shown. The umbilical guide assembly 50 is similar to the umbilical guide assembly 10. The riser interface assembly 52 of the umbilical guide assembly 50 is configured to mount to a shaft portion of the riser 12 rather than the flange located between riser sections. Like the umbilical guide assembly 10, the umbilical guide assembly 50 is also configured such that it can be installed using a remotely operated vehicle prior to the riser being deployed and secured to the sea floor. This configuration allows for added flexibility with respect to where the guide assembly 50 can be located vertically along the riser. However, it should be appreciated that the umbilical guide assemblies are configured such that they could also be mounted to the riser prior to or during deployment of the riser either manually or via ROV.

Figure 10:
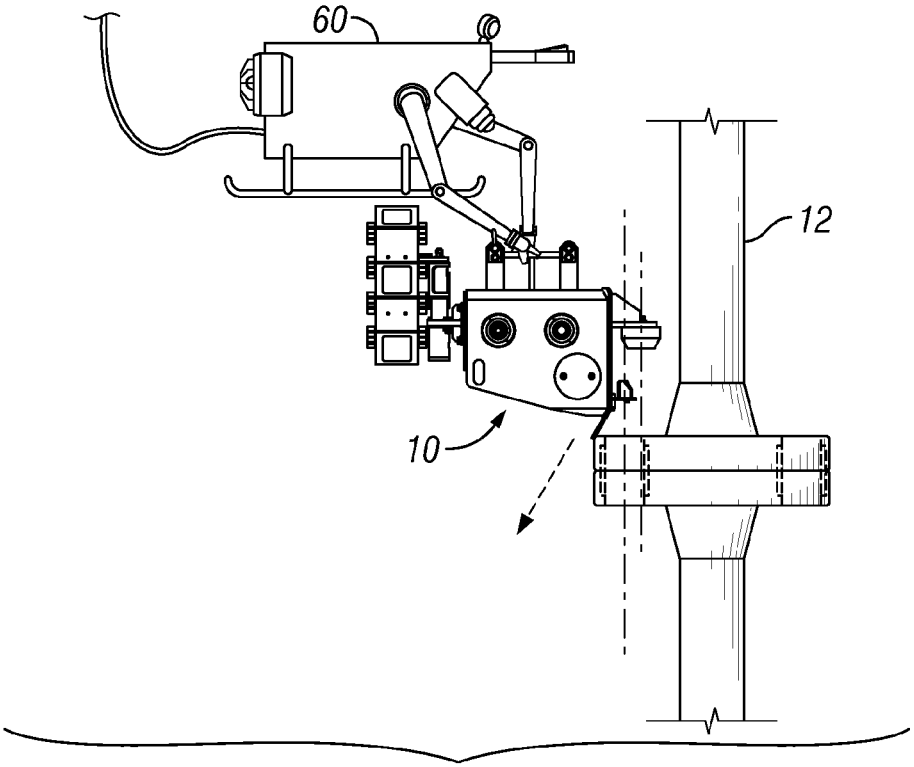
FIG. 10 is an illustration of the guide assembly of FIG. 2 being transported to the riser by a remotely operated vehicle.
Figure 11:
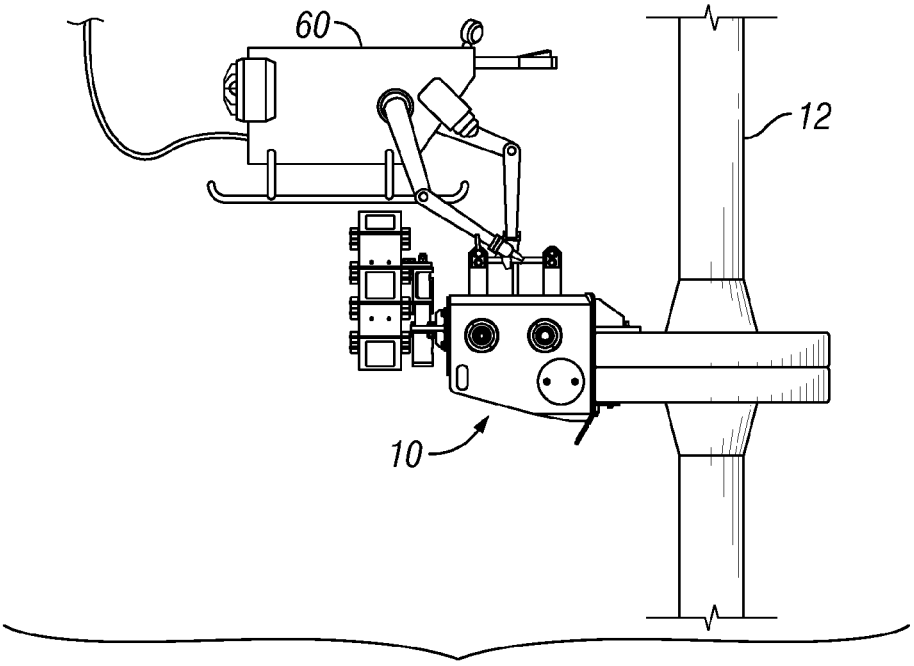
FIG. 11 is an illustration of the guide assembly of FIG. 2 being connected to the riser by the remotely operated vehicle.
Figure 12:
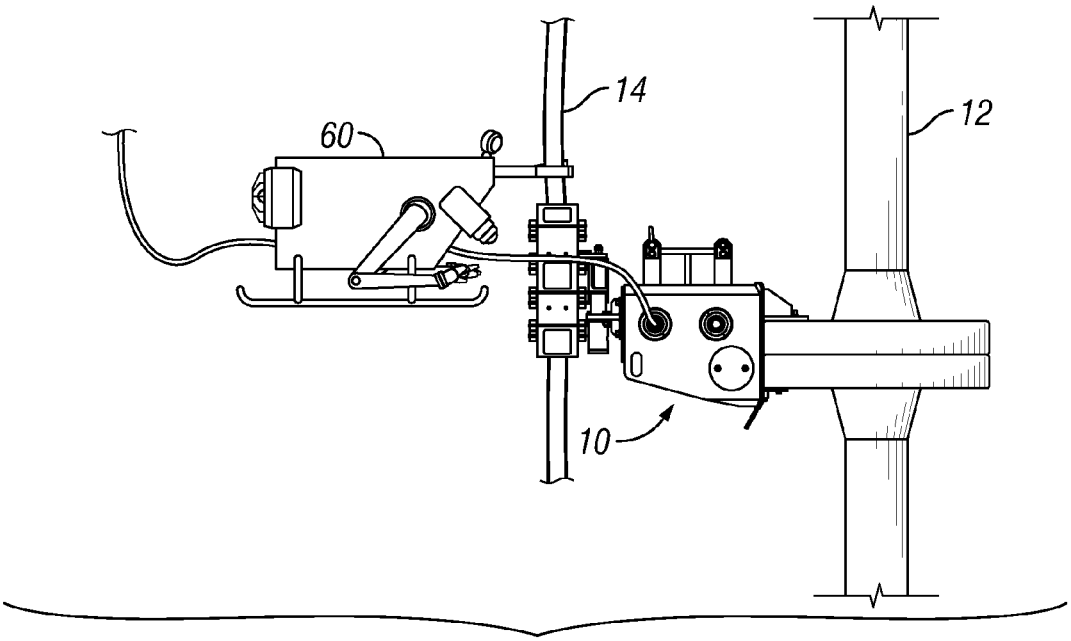
FIG. 12 is an umbilical being connected to the guide assembly of FIG. 2 by the remotely operated vehicle.

Referring to FIGS. 10-12, a method of securing an umbilical to a riser using the umbilical guide assembly is described in further detail. In the depicted embodiment the umbilical guide assembly 10 is shown being connected to the riser 12 with a remotely operated vehicle 60 while the riser 12 is underwater. In particular, FIG. 10 depicts a remotely operated vehicle 60 transporting the guide assembly 10 to the riser and aligning it with a portion of a riser flange located between adjacent sections of the riser 12. It should be appreciated that in other embodiments, including the embodiment shown in FIG. 9, the guide assembly can be connected to portions of the riser other than the flange area (e.g., main body or auxiliary lines of the riser). In the depicted embodiment after the guide assembly 10 is connected to the riser, the remotely operated vehicle locates the umbilical and transports the umbilical to the guide assembly. In the depicted embodiment the remotely operated vehicle has a curved front shovel portion that is configured to capture the umbilical and enable the remotely operated vehicle to drive the umbilical into place.

In the depicted embodiment, the remotely operated vehicle hydraulically connects to the guide assembly and actuates umbilical interface actuation assembly 28 to open the clam shell portion 26. The remotely operated vehicle 60 maneuvers the umbilical 14 so that a section of the umbilical 14 is adjacent the second portion 32 of the clam shell portion 26 and then closes the clam shell portion 26, thereby retaining the umbilical 14 therein and limiting the motion of the umbilical 14 in the horizontal plane while still allowing for longitudinal movement of the umbilical relative to the umbilical guide assembly.

The above specification, examples and data provide a complete description of the manufacture and use of the composition of the invention. Since many embodiments of the invention can be made without departing from the spirit and scope of the invention, the invention resides in the claims hereinafter appended.

We claim:

1. An umbilical guide assembly for securing an umbilical to a subsea drilling riser, the umbilical guide comprising:

an umbilical interface for securing the umbilical in relation to the subsea drilling riser, the umbilical interface including a clam shell portion having a first portion, a second portion, and a hydraulic drive mechanism that opens and closes the clam shell portion;

a riser interface configured to be mounted to the subsea drilling riser;

a frame that connects the riser interface and the umbilical interface, the frame including at least one hydraulic connection configured to be engaged by a remotely operated vehicle; and a frame mount connected to the frame, the frame mount including a driven pivot connection between the frame mount and the first portion of the clam shell portion and a pivot connection between the frame mount and the second portion of the clam shell portion;

wherein the hydraulic drive mechanism is configured to rotate the first portion of the clam shell portion relative to the second portion of the clam shell portion; and the pivot connection is configured to be mechanically locked to prevent movement of the second portion and mechanically unlocked to allow for movement of the second portion.

2. The umbilical guide assembly of claim 1, wherein an internal profile of the clam shell portion is tapered from a top end of the clam shell portion and tapered from a bottom end of the clam shell portion towards a central portion of the clam shell portion so as to define a curve having a radius of curvature that is greater than or equal to a minimum recommended radius of curvature for the umbilical to prevent the segment of umbilical secured in the umbilical interface from bending beyond a predetermined value at either the top end or bottom end of the clam shell portion.

3. The umbilical guide assembly of claim 1, wherein a cross-section of an inner profile of the clam shell portion includes two adjacent curves that each have a radius of curvature Rcc that is greater than or equal to a minimum recommended bend radius of the umbilical.

4. The umbilical guide assembly of claim 1, wherein an internal profile of the clam shell portion includes removable wear inserts.

5. The umbilical guide assembly of claim 1, wherein when the first portion pivots relative to the second portion from a closed position to an opened position, the first portion rotates through at least sixty degrees about a pivot axis.

6. The umbilical guide assembly of claim 1, wherein the riser interface is configured to be mounted to a shaft portion of the subsea drilling riser after the subsea drilling riser is secured to the ocean floor using the remotely operated vehicle.

7. The umbilical guide assembly of claim 1, wherein the at least one hydraulic connection includes a plug received therein, the plug being removable to allow connection of a hydraulic line of the remotely operated vehicle to the hydraulic connection.

8. The umbilical guide assembly of claim 7, further comprising a holding structure configured to temporarily hold the plug when the hydraulic line of the remotely operated vehicle is connected to the hydraulic connection.

9. An umbilical guide for securing an umbilical to a subsea drilling riser, the umbilical guide comprising:

a riser interface configured to engage the subsea drilling riser;

an umbilical interface configured to open to receive a segment of an umbilical and close to retain the segment of the umbilical relative to the subsea drilling riser such that the movement of the umbilical is limited in the horizontal direction while allowing the umbilical to move relative to the umbilical guide in a vertical direction, wherein the umbilical interface includes a generally cylindrical shell and an inner profile that is tapered from a bottom end and from a top end towards a central portion of the generally cylindrical shell so as to define a curve having a radius of curvature that is greater than or equal to a minimum recommended radius of curvature for the umbilical; and a frame connected between the riser interface and the umbilical interface, the frame including a hydraulic connection for mating with a remotely operated vehicle, wherein the inner profile has a minimum distance at the central portion larger than a maximum exterior diameter of the umbilical such that a circumferential gap exists between the inner profile and the umbilical.

10. The umbilical guide of claim 9, wherein the inner profile generally defines part of a circle having a constant radius.

11. The umbilical guide of claim 9, wherein the remotely operated vehicle includes a hydraulic fluid connector.

12. The umbilical guide of claim 9, wherein the hydraulic connection includes a plug received therein, the plug being removable to allow connection of a hydraulic line of the remotely operated vehicle to the hydraulic connection such that the riser interface and the umbilical interface are configured to be hydraulically actuated by the remotely operated vehicle.

13. A method of securing an umbilical to an umbilical guide connected to a subsea riser comprising:

mounting an umbilical guide to a subsea riser using a subsea remotely operated vehicle;

opening an umbilical interface portion of the umbilical guide, the umbilical interface portion including a generally cylindrical shell and an inner profile that is tapered from a bottom end and from a top end towards a central portion of the generally cylindrical shell so as to define a curve having a radius of curvature that is greater than or equal to a minimum recommended radius of curvature for the umbilical;

positioning an umbilical in the umbilical interface portion of the umbilical guide with a the subsea remotely operated vehicle;

removing a plug from a hydraulic connection on the umbilical guide;

connecting a hydraulic line of the subsea remotely operated vehicle to the hydraulic connection; and closing the umbilical interface portion around a portion of the umbilical using the subsea remotely operated vehicle via pressuring the hydraulic connection on the umbilical guide to retain the umbilical while still allowing for longitudinal movement of the umbilical relative to the umbilical interface portion, wherein upon closing the inner profile has a minimum distance larger than a maximum exterior diameter of the umbilical and a circumferential gap exists between the inner profile and the umbilical.

14. The method of claim 13, wherein the step of mounting the umbilical guide to the subsea riser using the subsea remotely operated vehicle includes aligning the umbilical guide with a portion of a riser flange located between adjacent sections of the subsea riser.

15. The method of claim 13, wherein the step of positioning the umbilical in the umbilical interface portion includes driving a portion of the subsea remotely operated vehicle against the umbilical and driving the umbilical into place relative to the umbilical guide.

16. The method of claim 13, wherein the step of closing the umbilical interface portion includes hydraulically pivoting a first portion of a clam shell portion relative to a second portion of the clam shell portion without pivoting the second portion of the clam shell portion.

17. The method of claim 13, further comprising temporarily storing the plug on a holding structure.

18. An umbilical guide assembly for securing an umbilical to a subsea drilling riser, the umbilical guide comprising:

an umbilical interface for securing the umbilical in relation to the subsea drilling riser, the umbilical interface including a clam shell portion having a first portion, a second portion, and a hydraulic drive mechanism that opens and closes the clam shell portion;

a riser interface configured to be mounted to the subsea drilling riser;

a frame that connects the riser interface and the umbilical interface, the frame including at least one hydraulic connection configured to be engaged by a remotely operated vehicle; and a frame mount connected to the frame, the frame mount including a driven pivot connection between the frame mount and the first portion of the clam shell portion and a pivot connection between the frame mount and the second portion of the clam shell portion;

wherein the hydraulic drive mechanism is configured to rotate the first portion of the clam shell portion relative to the second portion of the clam shell portion.

* * * * *